US007850155B2

(12) United States Patent
Mizubata et al.

(10) Patent No.: US 7,850,155 B2
(45) Date of Patent: Dec. 14, 2010

(54) SHEET FOLDING APPARATUS, SHEET POST-PROCESSING APPARATUS AND IMAGE FORMING APPARATUS

(75) Inventors: Tsuyoshi Mizubata, Tokyo (JP); Tomohiko Kiryu, Tokyo (JP); Mikihiro Yamakawa, Saitama (JP); Tsutomu Anezaki, Tokyo (JP); Satoru Shimizu, Tokyo (JP); Masato Niizuma, Tokyo (JP); Ryohei Sunayama, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 12/145,402

(22) Filed: Jun. 24, 2008

(65) Prior Publication Data

US 2009/0189326 A1 Jul. 30, 2009

(30) Foreign Application Priority Data

Jan. 28, 2008 (JP) ..... 2008-015940

(51) Int. Cl.

| | |
|---|---|
| ***B41F 13/56*** | (2006.01) |
| ***B41L 43/00*** | (2006.01) |
| ***B41L 43/12*** | (2006.01) |
| ***B41L 1/32*** | (2006.01) |
| ***B42C 1/00*** | (2006.01) |
| ***B42C 1/10*** | (2006.01) |
| ***B65H 33/04*** | (2006.01) |

(52) U.S. Cl. ..... 270/32; 270/20.1; 270/37; 270/39.01; 270/39.07; 270/45; 270/51; 270/58.07

(58) Field of Classification Search ..... 270/20.1, 270/32, 37, 39.01, 39.06, 39.07, 45, 51, 58.07
See application file for complete search history.

(56) References Cited

U.S. PATENT DOCUMENTS

| | | | | |
|---|---|---|---|---|
| 7,111,837 | B2 * | 9/2006 | Itou et al. | 270/45 |
| 2008/0001338 | A1 * | 1/2008 | Kotani | 270/37 |

FOREIGN PATENT DOCUMENTS

| | | | |
|---|---|---|---|
| JP | 62-74877 | A | 4/1987 |
| JP | 2004-99199 | | 4/2004 |
| JP | 2005-231777 | A | 9/2005 |
| JP | 2006-62810 | A | 3/2006 |

OTHER PUBLICATIONS

Japanese Office Action for Japanese Application No. 2008-015940 drafted Oct. 16, 2009 with English Translation.

* cited by examiner

*Primary Examiner*—Gene Crawford
*Assistant Examiner*—Yolanda Cumbess
(74) *Attorney, Agent, or Firm*—Cantor Colburn LLP

(57) ABSTRACT

A sheet folding apparatus including: a conveyance device having a first pair of rollers for nipping and conveying a paper sheet; a folding device disposed downstream of the conveyance device in a paper sheet conveyance direction, the folding device having a second pair of rollers for nipping and conveying the paper sheet, wherein the conveyance device conveys the paper sheet to the folding device by making the paper sheet bent toward the folding device, and the folding device conveys the bent paper sheet to fold the paper sheet; and a folding assist member for pushing the paper sheet so that the paper sheet moves toward the folding device, the folding assist member being pivotally arranged to be capable of rotating downstream of the conveyance device in the conveyance direction.

12 Claims, 4 Drawing Sheets

SHEET FOLDING APPARATUS, SHEET POST-PROCESSING APPARATUS AND IMAGE FORMING APPARATUS

CROSS REFERENCE TO RELATED APPLICATION

The present application is based on Japanese Patent Application No. 2008-015940 filed with Japanese Patent Office on Jan. 28, 2008, the entire content of which is hereby incorporated by reference.

BACKGROUND OF THE INVENTION

1. Technical Field

The present invention relates to a sheet folding apparatus, a sheet post-processing apparatus and an image forming apparatus, which perform a folding process of a sheet.

2. Description of Related Art

A sheet folding apparatus for folding a sheet into the shape of half-fold, which folds a sheet at a center line, and of three-fold, is widely used as a sheet post-processing apparatus of an image forming apparatus, such as an electrophotography image forming apparatus.

For example, Unexamined Japanese Patent Application Publication No. 2004-99199 (JPA2004-99199) discloses a sheet folding apparatus, which performs half-fold or three-fold using a plurality of rollers.

In the sheet folding apparatus disclosed in JPA2004-99199, the first folding process of a paper sheet is performed by nipping the paper sheet and conveying the paper sheet with a pair of rollers in the upstream side, and the second folding process of a sheet is preformed by nipping the paper sheet and conveying the paper sheet with a pair of rollers in the downstream side.

The sheet folding apparatus disclosed in JPA2004-99199 can perform half-fold or three-fold of a sheet.

In the sheet folding apparatus disclosed in JPA2004-99199, the first folding process is performed by inserting a sheet between a pair of rollers in the upstream side by using a folding plate.

And the sheet is inserted between a pair of rollers in the downstream by butting the sheet against an edge stop member and making the sheet crooked by the conveyance of the pair of rollers in the upstream side, and the second folding process is performed by this sheet insertion.

FIG. 1 schematically illustrates the sheet folding apparatus disclosed in JPA2004-99199.

As illustrated in FIG. 1, a paper sheet S is nipped and conveyed by a pair of rollers R1 and R2 in the upstream side, and the edge of the sheet butts against the edge stop member T. Then, the paper sheet S stops.

When rollers R1 and R2 rotate further and convey the paper sheet S, the paper sheet S is crooked in the middle toward the side of the pair of rollers R2 and R3 in the downstream side.

The edge of a crooked section of the paper sheet S advances into the nip between rollers R2 and R3.

When the rollers R2 and R3 rotate, the folding process of the paper sheet S is preformed while being conveyed by the rollers R2 and R3.

The guiding member G between the rollers R1 and R2 and the edge stop member T forms a crooked conveyance path so that the paper sheet S is made crooked toward the rollers R2 and R3 side.

However, the paper sheet S may be crooked in the opposite side, which departs from rollers R2 and R3 side but not toward the roller R2 and R3, by the conveyance of the rollers R1 and R2 depending on the state of the paper sheet S.

Irregular crookedness of such a paper sheet S is generated in the case where the paper sheet S is curled.

When irregular crookedness of such a paper sheet S takes place, malfunctions, in which caused is poor conveyance, such as jam, and poor folding with a bent fold line or a slanting fold line, will occurs.

In order to avoid this, it may be feasible to form the structure of the guiding member G so that the paper sheet S is made crooked strongly. But, when it does so, smooth conveyance of sheet S will be impeded and it will become easy to generate poor conveyance, such as jam.

In the sheet folding apparatus illustrated in FIG. 1, since the space in which a paper sheet can move freely between the nip of rollers R1 and R2 and the upstream side edge of the guiding member G is formed and control of the paper sheet S in this space is difficult too be performed, the problem (i.e., poor conveyance) mentioned above and a poor folding process may occur.

SUMMARY

An apparatus reflecting one aspect of the present invention is a sheet folding apparatus, which includes a conveyance device having a first pair of rollers for nipping and conveying a paper sheet;

a folding device disposed downstream of the conveyance device in a paper sheet conveyance direction, the folding device having a second pair of rollers for nipping and conveying the paper sheet, wherein the conveyance device conveys the paper sheet to the folding device by making the paper sheet bent toward the folding device, and the folding device conveys the bent paper sheet to fold the paper sheet; and a folding assist member for pushing the paper sheet so that the paper sheet moves toward the folding device, the folding assist member being pivotally arranged to be capable of rotating downstream of the conveyance device in the conveyance direction.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENTS

Although the present invention is explained based on an embodiment of illustration, the present invention is not limited to this embodiment.

An image forming apparatus related to an embodiment of the present invention will be explained based on an illustration.

[Image Forming System]

Figure 2:
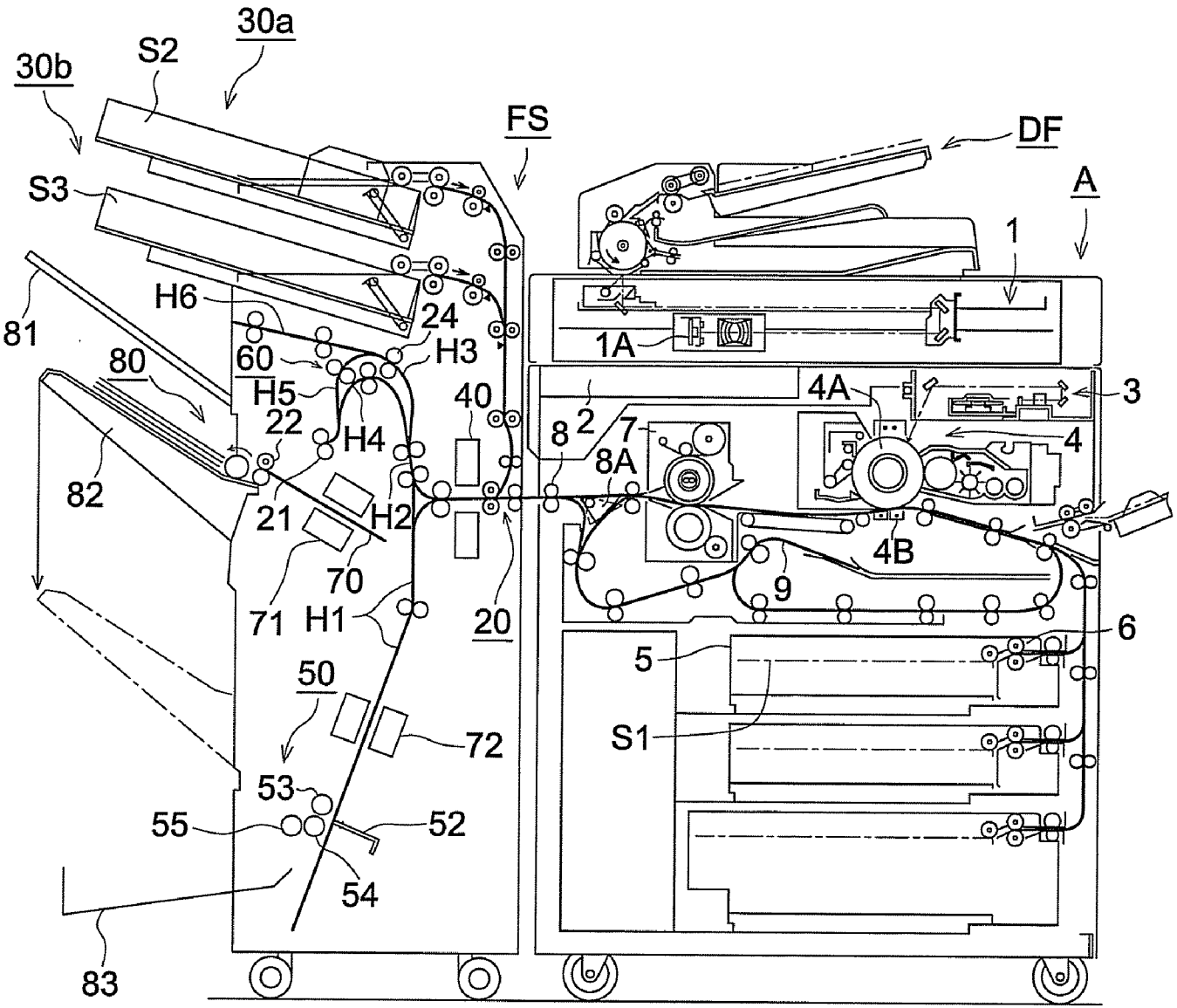
FIG. 2 illustrates a general view of the image forming apparatus related to an embodiment of the present invention.

FIG. 2 illustrates a general view of the image forming system related to an embodiment of the present invention, which is configured by an image forming apparatus A and a sheet post-processing apparatus FS.

<Image Forming Apparatus A>

An image forming apparatus A of illustration is equipped with an image reading section 1, an image processing section 2, an image writing section 3, an image forming section 4, a paper sheet feeding cassette 5, a paper sheet feeding device 6, a fixing apparatus 7, a sheet paper ejection section 8, and an automatic duplex copy paper sheet feeding section (ADU) 9.

An automatic document feeding apparatus DF is mounted in the upper portion of the image forming apparatus A. A sheet post-processing apparatus FS is connected at the side of the paper sheet ejection section 8 in the left-hand side of illustration of the image forming apparatus A.

The document placed on the document table of automatic document feeding apparatus DF is conveyed in an arrow direction. The image of one side or both sides of the document is read by the optical system of the image reading section 1, and is read into a CCD image sensor 1A.

The analog signal, to which photo electric conversion has been conducted by the CCD image sensor 1A, is transmitted to the image writing section 3 after analog processing, an A/D conversion, a shading compensation, an image-compression process have been applied to the analog signal in the image processing section 2.

At the time of image formation, an outputted light is emitted from a semiconductor laser of the image writing section 3, a photoconductive drum 4A of the image forming section 4 is irradiated, and a latent image is formed. In the image forming section 4, processes, such as, charging, exposure, development, transfer, separation and cleaning are performed. The recording paper sheet S1 fed from a paper sheet feeding cassette 5 by a paper sheet feeding device 6 contacts a photoconductive drum 4A on which a toner image has been formed by a development process of a latent image, and the toner image is transferred onto the recording paper sheet by a transfer means 4B. The toner image held on the recording paper sheet S1 is fixed thereon by the fixing apparatus 7, and the recording paper sheet S1 is sent into a sheet post-processing apparatus FS from the paper sheet ejection section 8. In case of a double-sided copy, the recording paper sheet S1 having finished one side image processing should be sent into the automatic double-sided paper sheet feeding section 9 by a conveyance path switching plate 8A. And after image formation of the recording paper sheet S1 is carried out to the back surface and the image is fixed onto the recording paper sheet S1 in the image forming section 4, the recording paper sheet S1 is ejected from the paper sheet ejection section 8.

Figure 1:
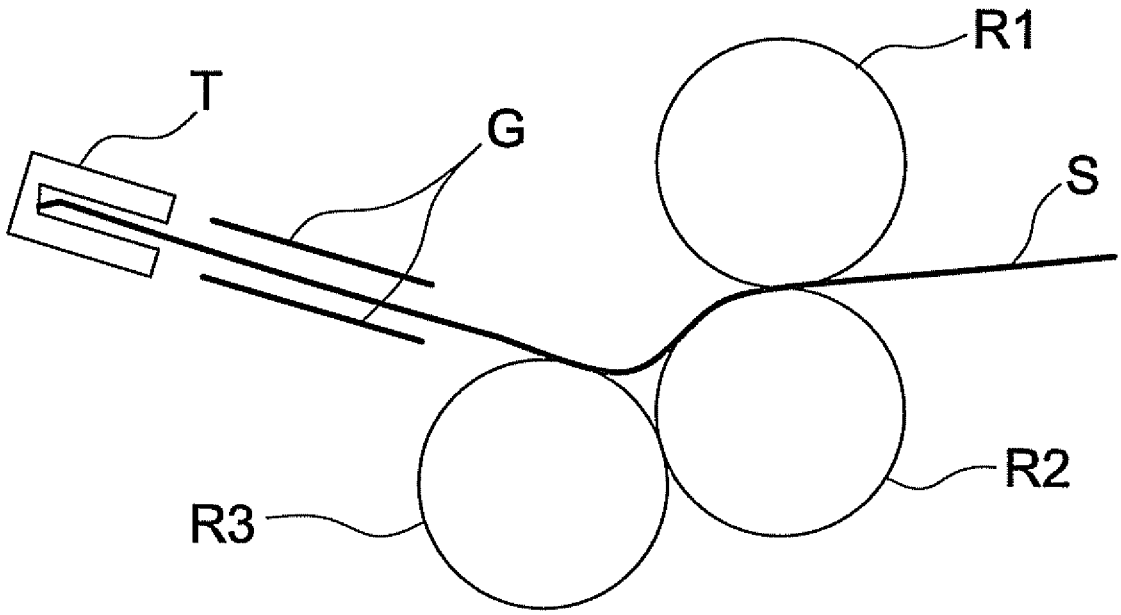
FIG. 1 schematically illustrates a diagram of a conventional sheet folding apparatus.

Next, a paper sheet post-processing apparatus related to an embodiment of the present invention is explained using FIG. 1.

[Paper Sheet Post-Processing Apparatus FS]

The paper sheet post-processing apparatus FS includes a paper sheet carrying-in section 20, insertion sheet feeding sections 30*a* and 30*b*, and a plurality of post-processing sections. A post-processing section includes a punching process section 40, a folding process section 50, an overlapping process section 60, binding process sections 71 and 72 and a paper sheet ejection section 80.

The insertion sheet feeding section 30*a* is loaded with insertion sheets S2, and the insertion sheet feeding section 30*b* is loaded with other insertion sheets S3.

The insertion sheets S2 and S3 are paper sheets which will be inserted among the recording paper sheets S1 ejected from the image forming apparatus A, such as a cover sheet and a paper sheet to be inserted. A punching process and a folding process can be performed to the insertion sheets S2 and S3 as well as the recording paper sheets S1.

The insertion sheets S2 and S3 sent out from the insertion sheet feeding sections 30*a* and 30*b* are arranged to pass through the conveyance path heading downward (with no referential mark) and to be conveyed to the paper sheet carrying-in section 20.

The punching process section 40 is arranged at the paper sheet carrying-in section 20.

In addition, in the following explanation, the recording paper sheet S1, the insertion sheets S2 and S3 are generically named a paper sheet S.

The folding process section 50 is placed on a conveyance path H1, which branches downward from the paper sheet carrying-in section 20.

An overlapping process section 60 is arranged in the downstream side of the conveyance path H2, which branches from the paper sheet carrying-in section 20 upward, and is equipped with the conveyance paths H3, H4 and H5.

The overlapping process section 60 makes the following paper sheet S stand-by at the conveyance paths H3, H4 and H5, in order to secure the time for binding and processing the preceding paper sheet S in a binding process section 71 located in a downstream side.

The conveyance path located in the downstream side of the conveyance path H2 branches to the conveyance path, which doubly curves, and is divided into the inside conveyance path H4 and the outside conveyance paths H3 and H5.

The conveyance rollers 21 are provided in the outlet of the conveyance path H4, which forms the inside conveyance path, being branched from the conveyance path H2 and curved. In cases where the first paper sheets S, to which a binding process is to be applied, has been conveyed, the first paper sheet S is made to stand-by in the state where the edge of the paper sheet S contacts the conveyance rollers 21 which being stopped rotation to receive the edge of the paper sheet.

As mentioned above, the paper sheet S conveyed on the conveyance path H2 stands by in the state where the edge is butting against the conveyance rollers 21. However, the following paper sheet S enters into the conveyance path H3 from the conveyance path H2, and reaches the conveyance rollers 21.

Two sheets are conveyed together from the conveyance rollers 21, and further conveyed to an accumulation section 70 in the state that the preceding paper sheet S and the following paper sheet S are lapped.

The conveyance path H3 is continuing from the conveyance path H2 in the downstream of the conveyance path H2, and the conveyance path H5 continues from the conveyance path H3.

The conveyance path H3 is branched to the conveyance path H5 and the conveyance path H6.

And the conveyance path H6 forms a paper sheet ejection path which ejects the paper sheet S on a fixed ejection tray 81.

The fixed ejection tray 81 is positioned at a downstream side of the conveyance path H6, which branches from the overlapping process section 60 near the conveyance roller 24 on the conveyance path H3, and is disposed at the position, which projects outside the sheet post-processing apparatus FS.

As explained above, the fixed ejection tray 81 accumulates the paper sheet S conveyed through the conveyance path H2, H3, and H6 and ejected.

The paper sheet ejection section 80 includes the ejection rollers 22 and a matching mechanism, and ejects the paper sheet S onto a rise-and-fall ejection tray 82. Although the alignment mechanism is not illustrated, the alignment mechanism is structured by a known mechanism, which reciprocally moves in the horizontal direction, which is perpendicular to the conveyance ejection direction, and aligns the paper sheet.

The ejection rollers 22 are structured by a pair of rollers, and at the time of un-ejecting paper sheet, the pair of rollers is separated. And at the time of sheet ejection, the pair of rollers nips, conveys and ejects the paper sheets S to the rise-and-fall ejection tray 82.

When the paper sheet S conveyed by the conveyance roller 21, it runs between the estranged pair of rollers configuring the ejection roller 22 in the leftward; when the back end departs from the conveyance roller 21, the paper sheet S falls to the accumulation section 70; the paper sheet S is slipped down on the accumulation section 70; and the paper sheet S is caught by the stopper (not shown), and stops at the accumulation section 70.

When the paper sheet S of the setting number of sheets is accumulated on the accumulation section 70, the binding process section 71 operates, and the paper sheet S is bound and processed.

The paper sheet S to which the binding process has been applied, is pushed up by the above-mentioned stopper, and moved on the accumulation section 70 in the upper left direction.

At this time, the pair of rollers, which configures the ejection rollers 22, contacts, nips, conveys and ejects the paper sheet S to the rise-and-fall ejection tray 82.

In a folding mode, the paper sheet S is conveyed downward in the conveyance path H1 from the paper sheet carrying-in section 20, and in the folding process section 50, a center fold process or a three-fold process is performed and the paper sheet S is ejected to a lower ejection tray 83.

In a saddle stitching mode, the paper sheet S is conveyed through the paper sheet carrying-in section 20 and the conveyance path H1; a saddle stitching process is performed in the binding process section 72; and in the folding process section 50, the paper sheet S is ejected on the lower ejection tray 83, after a center fold process is performed.

There are the following four paths as ejecting routes of the paper sheet S. 1) Paper sheet carrying-in section 20->conveyance path H2->conveyance path H3->conveyance path H6->fixed ejection tray 81; 2) paper-sheet carrying-in section 20->conveyance path H2->the conveyance paths H3, H4, and H5->accumulation section 70->paper sheet ejection section 80->rise-and-fall ejection tray 82; 3) paper-sheet carrying-in section 20->conveyance path H2->H4->paper sheet ejection section 80->rise-and-fall ejection tray 82; and 4) paper-sheet carrying-in section 20->conveyance path H1->folding process section 50->lower ejection tray 83. Paths 1, 2, and 4 are as having explained above.

The path 3 is chosen, when performing a lot of image formation without giving a binding process or a folding process.

The paper sheet S is ejected on the rise-and-fall ejection tray 82 without post-processing, and the rise-and-fall ejection tray 82 moves downward so that the top surface of the paper sheet S to be ejected always becomes the fixed height, as the chained line illustrated in the figure.

Therefore, it is possible to accumulate thousands of paper sheets on the rise-and-fall ejection tray 82.

Figure 3:
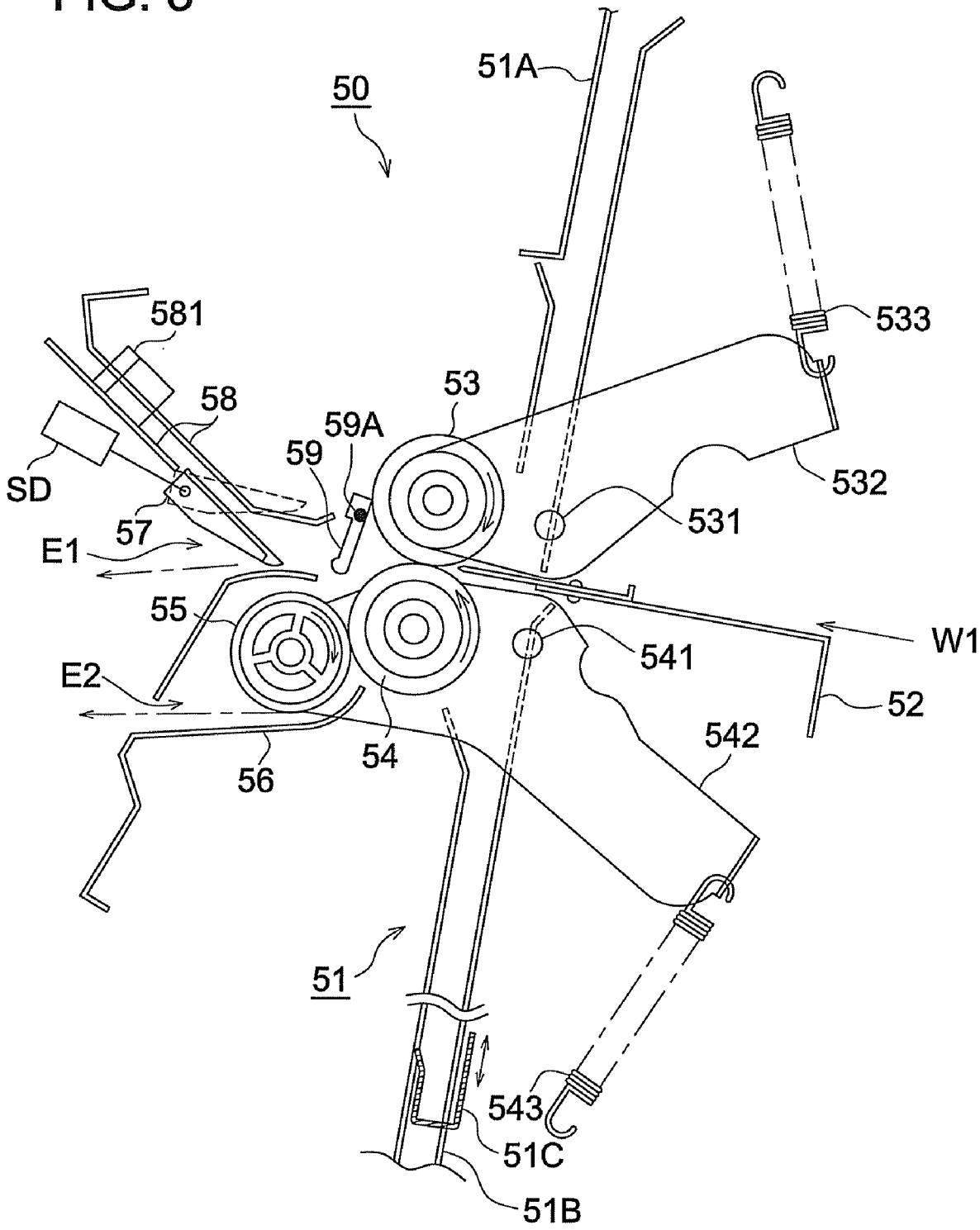
FIG. 3 illustrates a front view of a folding process section 50.

FIG. 3 illustrates a front view of the folding process section 50.

The conveyance path H1 in FIG. 2 is structured by a guiding members 51 configured by a guide plate 51A, which guide the paper sheet S at the upper section of the folding process section 50 and a guide plate 51B, which guides the paper sheet S at the downstream section.

The regulation member 51C, which regulates the position of the paper sheet S in the downstream side of the folding process section 50, is provided in the conveyance path H1. The regulation member 51C can regulate the lower limit of the paper sheet S in a predetermined position, and can be displaced according to paper sheet size.

The folding process section 50 is configured by a folding plate 52, a fold upper roller (it will be called an upper roller hereafter) 53, a fold lower roller (it will be called a lower roller hereafter) 54, a folding roller 55, a conveyance path change member 57 as a change guidance device, a guiding member 58 as a guiding device, and an edge stop member 581. In the folding process section 50, a half-fold process or a three-fold process is performed for the paper sheet S.

The upper roller 53 and the lower roller 54, which will be a first pair of rollers, make the paper sheet S crooked by conveyance, and configure the conveyance device for inserting the paper sheet S between the lower roller 54 and the folding roller 55.

The lower roller 54 and the folding roller 55, which will be a second pair of rollers, configure the folding device, which performs the folding process of the paper sheet S by nipping and conveying the paper sheet S.

In a three-fold process, the upper roller 53 and the lower roller 54 configure the first portion of the folding device, which performs the first folding process, while performing a folding process in a half-fold.

Although the lower roller 54 is shared by the above-mentioned conveyance device and the above-mentioned folding device, it is also possible to configure the above-mentioned conveyance device and the above-mentioned folding device by a pair of rollers respectively to configure the sheet folding apparatus by four rollers.

The upper roller 53 and the lower roller 54 are supported by pressure devices of a right-and-left pair, which makes a substantially symmetric figure. One pressure device pivotally supports the upper roller 53. The pressure device is configured by a support plate 532 capable of swinging centering on a pivot 531 and a spring 533, which energizes the upper roller 53 in the nipping position direction, the spring 533 being held at one end of the support plate 532. Another pressure device is held by the end of a support plate 542 capable of swing centering on a pivot 541 and a spring 543, which energizes the upper roller 54 in the nipping position direction. Drive rotation of the upper roller 53 and the lower roller 54 is performed by a folding roller drive motor (not shown). Each peripheral surface of the upper roller 53 and the lower roller 54 is formed by a high frictional resistance material.

The conveyance path change member 57 as a change guidance device is driven by a solenoid SD and the conveyance path change member 57 is capable of oscillating. At the time of a three-fold process, the conveyance path change member 57 is set at the position illustrated by a solid line, and arranged to guide the paper sheet S to the conveyance path formed by the guiding member 58.

The conveyance path change member 57 is set at the position of a dotted line at half-fold, i.e., a center-fold, and a saddleback stitching and a center fold, and guides the paper sheet S to an outlet E1.

58 is a guiding member for guiding the paper sheet S as a guidance device between a conveyance device and the edge stop member 581, and forms the conveyance path so that the central part of the paper sheet S is crooked downward.

Numeral 59 is a folding assist member.

The edge stop member 581 configures a paper sheet bending member, which crooks the paper sheet S toward the folding device, and makes it crooked by stopping the edge of the paper sheet S conveyed by a conveyance device, i.e., the upper roller 53 and the lower roller 54.

With respect to the paper sheet bending member, it is also possible to configure the paper sheet bending member by the roller, which conveys the edge of the paper sheet S toward the opposite direction of the transportation direction of the upper roller 53 and the lower roller 54 besides the edge stop member 581.

In cases where the paper sheet bending member is configured by a roller, the roller as a paper sheet bending member operates so that the paper sheet S may be conveyed to the opposite direction of transportation direction of the conveyance device when the fold position of the paper sheet S reaches to the folding position by the folding device.

A fold operation of the folding process section 50 having the above structure will be explained. 1) Three-fold: In three-fold, the conveyance path change member 57 guides the paper sheet S to the conveyance path formed by the guiding member 58.

The paper sheet S is conveyed to the conveyance path H1, and the edge butts against the regulation member 51C, and stops.

In the stage where the paper sheet S of setting number of sheets has regulated and accumulated by the regulation member 51C, the folding plate 52 is driven by a driving device (not shown). The folding member 52 moves in the direction, which is illustrated by an arrow W1, and inserts the crease of the paper sheet S between the upper roller 53 and the lower roller 54.

At the same time of an operation of the folding plate 52, the upper roller 53, the lower roller 54 and the folding roller 55 respectively rotate in an arrow direction and convey the paper sheet S while performing the folding process of the paper sheet S.

The folding plate 52 moves and evacuates to the opposite direction of the arrow W1 at the stage where the paper sheet S has been nipped between the upper roller 53 and the lower roller 54.

The paper sheet S, to which the folding process has been applied with the upper roller 53 and the lower roller 54, is conveyed in the state that the crease is positioned in the top, and the crease butts against the edge stop member 581.

Even after the crease of the paper sheet S butts against the edge stop member 581, the upper roller 53, the lower roller 54 and the folding roller 55 continue rotation.

The paper sheet S bends and curves between the nip formed between the upper roller 53 and the lower roller 54, and the edge stop member 581 by continuation of rotation of the upper roller 53 and the lower roller 54.

As illustrated, the guiding member 58 is structured so that the paper sheet S, which passed the upper roller 53 and the lower roller 54, crooked downward.

Therefore, the paper sheet S curves downward.

The curved paper sheet S advances into the nip between the lower roller 54 and the folding roller 55, and the second crease is formed by the lower roller 54 and the folding roller 55.

The paper sheet S, to which the three fold process was applied, i.e., the paper sheet S folded at two places is ejected from the folding process section 50 by the rotation continuation of the lower roller 54 and the folding roller 55, and it is ejected to the lower ejection tray 83.

In the above-mentioned folding process, due to the curl of the paper sheet S, the paper sheet S may curve upwards between the nip formed between the upper roller 53 and the lower roller 54, and the edge stop member 581, or may not curve uniformly with respect to the width direction of the paper sheet S.

Due to these phenomena, the case of poor conveyance, such as Jam, and the case where folding process in which right creases are not formed, occur.

Such a problem will be solved by the auxiliary holding member 59.

Figure 4:
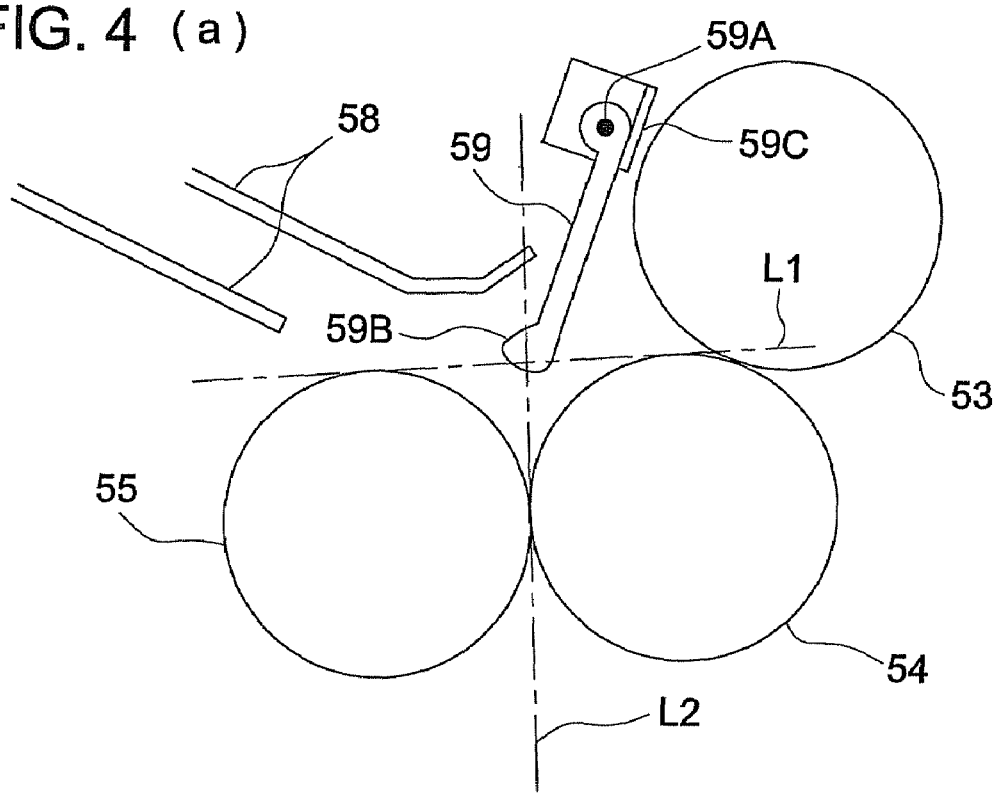
FIGS. 4(*a*) and 4(*b*) illustrate an enlarged view of a folding assist member 59.
Figure 4:
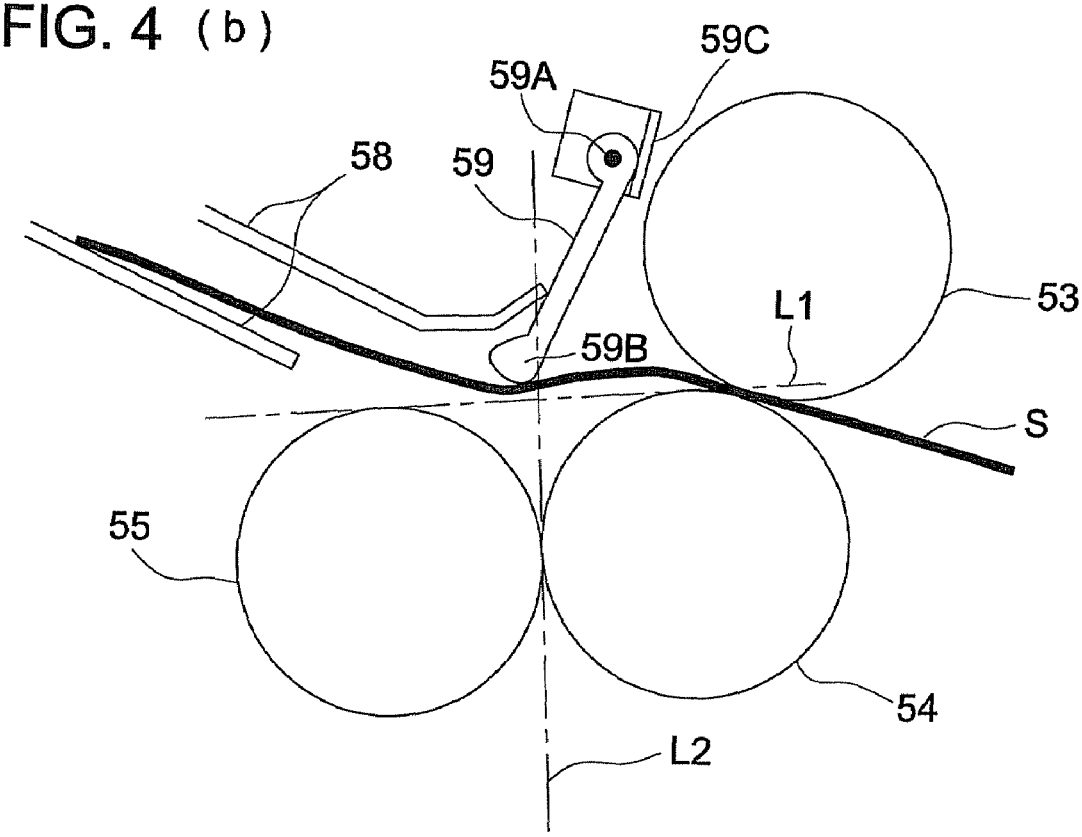

The auxiliary holding member 59 will be explained by referring to FIGS. 4(*a*) and 4(*b*). FIGS. 4(*a*) and 4(*b*) illustrate an enlarged view of the auxiliary holding member 59.

At the time of non-paper sheet to be processed, i.e., when there is no paper sheet S in the folding process section 50, the folding assist member 59 is arranged to be in the position where the edge section 59B is to be at seven o'clock corresponding to the gravity as illustrated in FIG. 4(*a*).

This position is determined by the angle at which the counterclockwise rotation of the folding assist member 59 sagging due to the gravity is regulated by a stopper 59C.

As shown in FIG. 4(*b*), when the paper sheet S advances into the folding process section 50, the folding assist member 59 will constitute an angle at which the folding assist member 59 is pushed by the paper sheet S and rotated clockwise. Since the folding assist member 59 tends to rotate counterclockwise by the action of the gravity, pressure to the paper sheet S is applied downward by the folding assist member 59 between the upper roller 53 and the lower roller 54 and the edge stop member 581.

By this pressing force of the folding assist member 59, bending of the paper sheet S always turns into bending downward; the paper sheet S advances with the head of the portion which should constitute the second crease between the lower roller 54 and the folding roller 55; and the second crease is formed correctly.

In order to effectively operate the fold auxiliary action by the folding assist member 59 as illustrated in FIGS. 4(*a*) and 4(*b*), in the state of non-paper sheet to be processed as illustrated in FIG. 4(*a*), it is more desirable that the edge section 59B of the folding assist member 59 is positioned lower than the upper side of the common tangent L1 of the roller 54 configuring a conveyance device and the folding roller 55 configuring a folding device, i.e., which is located in the folding device side.

In addition, it is desirable that the edge section 59B of the folding assist member 59 at the time of non-paper sheet to be processed is on the tangent L2, which passes along the nip between the lower roller 54 and the folding roller 55, which configure a folding device.

In addition, in order to make conveyance of the paper sheet S smooth, it is desirable that the edge section 59B, which guides the paper sheet S, is formed into a curved surface.

As for the folding assist member 59, it is desirable to be formed by a material having a degree of mass, which can depress the paper sheet S, and it may be formed by resin, rubber or metal.

Although the folding assist member 59 has guided the paper sheet S downward in the action of gravity in the example of illustration, the paper sheet S may be guided downward by the biasing force of a spring. However, as biasing force of the spring, it is desirable that the biasing force is set at a degree that the folding assist member 59 is pushed and rotated clockwise at the time of paper sheet penetration.

A plurality of folding assist members 59 is provided at a plurality of places in the width direction (direction, which is perpendicular to the transportation direction and along the conveyance side) of the paper sheet S.

2) Half-Fold (Center Fold, and Saddle Stitching and Center Fold):

A center fold process is the mode in which the paper sheet S is folded in the central part with respect to the transportation direction of the paper sheet S, and a center fold and saddle stitching is the mode, which performs a center fold process in the above-mentioned central part while binding and processing the above-mentioned central part of the paper sheet S.

Setting number of sheets is caught by the regulation member 51C, and is accumulated.

In the case of center fold and saddle stitching, the binding process section 72 of FIG. 2 operates in this stage, and a binding process for shooting a bind needle in the central part of the paper sheet S is performed. After the binding process, the paper sheet S is conveyed until the edge of the paper sheet S contacts the regulation member 51C. After the edge of a paper sheet is regulated by the regulation member 51C, the crease of the paper sheet S is inserted by the drive of the folding plate 52 between the upper roller 53 and the lower roller 54.

In the case of the center fold, in the accumulated stage where the paper sheet S of setting number of sheets are regulated by the regulation member 51C, the folding plate 52 is driven by a driving device (not shown), and the crease of the paper sheet S is inserted between the upper roller 53 and the lower roller 54.

In either case of a center fold or a center fold and saddle stitching, when operating the folding plate 52, at the same time, the upper roller 53 and the lower roller 54 rotate in an arrow direction. And the paper sheet S is conveyed while performing the folding process of the paper sheet S.

The folding plate 52 moves and evacuates to the opposite direction of the arrow W1 in the stage where nip of the paper sheet S is performed between the upper roller 53 and the lower roller 54.

The paper sheet S, to which the folding process has been applied, is conveyed by the upper roller 53 and the lower roller 54 under the state that the crease is set at the top; the paper sheet S passes under the conveyance path change member 57 with guidance thereof, which has been set as illustrated at the position of a dotted line; and the paper sheet S is ejected from an outlet E1.

In a center fold, and saddle stitching and center fold mode, since the folding assist member 59 is pushed by the paper sheet S and the folding assist member 59 rotates clockwise and evacuates, the conveyance of the paper sheet S is performed smoothly.

In the present invention, the folding assist member, which is pivotally supported, presses the paper sheet to the folding device and pressure.

Therefore, the paper sheet is securely crooked in the folding device side, and the folding process, which makes the exact crease, is performed while poor conveyance is prevented.

In addition, a folding assist member is pushed by the paper sheet, and the folding assist member rotates. Therefore, although strong force is applied against a folding assist member at the time of a paper sheet folding process and jam release work, a folding assist member rotates corresponding to the force. Thus, wear and breakage of the folding assist member can be prevented.

What is claimed is:

1. A sheet folding apparatus comprising:

a first folding device having a first pair of rollers for nipping, folding, and conveying a paper sheet;

a second folding device disposed downstream of the first folding device in a paper sheet conveyance direction, the second folding device having a second pair of rollers for nipping and conveying the paper sheet, wherein the first folding device conveys the paper sheet to the second folding device by making the paper sheet bent toward the second folding device, and the second folding device conveys the bent paper sheet to fold the paper sheet; and a folding assist member being pivotally arranged downstream of the first folding device in the conveyance direction of the first pair of rollers and opposite to the second pair of rollers, and structured to rotate toward downstream in the conveyance direction by press of a leading edge of the paper sheet and to rotate to push the paper sheet folded by the first pair of rollers toward the second folding device while the paper sheet is conveyed by the first pair of rollers.

2. The sheet folding apparatus of claim 1, further comprising a paper sheet bending member, disposed downstream of the first folding device in the conveyance direction, which bends the paper sheet toward the second folding device.

3. The sheet folding apparatus of claim 1, wherein the folding assist member pushes the paper sheet toward the second folding device by an action of gravity force.

4. The sheet folding apparatus of claim 1, further comprising a spring to bias the folding assist member so that the folding assist member pushes the paper sheet toward the second folding device.

5. The sheet folding apparatus of claim 1, the first pair of rollers of the first folding device nips and conveys the paper sheet to fold the paper sheet, and the sheet folding apparatus is capable of folding the paper sheet with three-fold by utilizing the first folding device and the second folding device.

6. The sheet folding apparatus of claim 5, further comprising a change guidance device which switches whether to guide the paper sheet passed through the first folding device into the second folding device or into an ejection section, so as to switch whether to fold the paper sheet with three-fold or with half-fold.

7. The sheet folding apparatus of claim 1, wherein one of the first pair of rollers is commonly used as one of the second pair of rollers.

8. The sheet folding apparatus of claim 1, wherein the folding assist member has an edge portion with a curved face to guide the paper sheet.

9. The sheet folding apparatus of claim 1, wherein when the paper sheet is not conveyed by the first pair of rollers, an edge portion of the folding assist member is positioned in a side of the second folding device with respect to a common tangent line of the first pair of rollers.

10. The sheet folding apparatus of claim 1, wherein when the paper sheet is not conveyed by the first pair of rollers, an edge portion of the folding assist member is positioned on a tangent line, which passes through a nip between the second pair of rollers.

11. A sheet post-processing apparatus comprising the sheet folding apparatus of claim 1.

12. An image forming system comprising the sheet folding apparatus of claim 1.

* * * * *